US012048887B2

(12) United States Patent
Shaanti

(10) Patent No.: US 12,048,887 B2
(45) Date of Patent: Jul. 30, 2024

(54) MELODIMAN MUSICAL TOY FIGURINE

(71) Applicant: Rohan Shaanti, Etobicoke (CA)

(72) Inventor: Rohan Shaanti, Etobicoke (CA)

( * ) Notice: Subject to any disclaimer, the term of this patent is extended or adjusted under 35 U.S.C. 154(b) by 224 days.

(21) Appl. No.: 17/852,613

(22) Filed: Jun. 29, 2022

(65) Prior Publication Data

US 2023/0001316 A1 Jan. 5, 2023

Related U.S. Application Data

(60) Provisional application No. 63/217,753, filed on Jul. 1, 2021.

(51) Int. Cl.

| | |
|---|---|
| ***A63H 3/16*** | (2006.01) |
| ***A63H 3/00*** | (2006.01) |
| ***A63H 3/28*** | (2006.01) |
| ***A63H 3/52*** | (2022.01) |
| ***A63H 5/00*** | (2006.01) |

(52) U.S. Cl.

CPC ..... *A63H 5/00* (2013.01); *A63H 3/003* (2013.01); *A63H 3/006* (2013.01); *A63H 3/16* (2013.01); *A63H 3/28* (2013.01); *A63H 3/52* (2013.01); *A63H 2200/00* (2013.01)

(58) Field of Classification Search

CPC ..... A63H 3/16; A63H 3/28; A63H 5/00

See application file for complete search history.

(56) References Cited

U.S. PATENT DOCUMENTS

| | | | | |
|---|---|---|---|---|
| 4,869,701 A * | 9/1989 | Kawai | G09B 1/36 446/99 |
| 5,295,889 A * | 3/1994 | Ejima | A63H 3/16 446/297 |
| 5,788,554 A * | 8/1998 | Goodwin | A63H 3/46 446/99 |
| 7,520,793 B2 * | 4/2009 | Pillai | A63H 3/16 446/99 |
| 9,539,520 B2 * | 1/2017 | Rotbard | A63H 33/042 |
| 9,861,903 B1 * | 1/2018 | Mariasov | A63H 3/46 |
| 11,241,634 B2 * | 2/2022 | Lawber | A63H 33/26 |

* cited by examiner

*Primary Examiner* — John A Ricci

(74) *Attorney, Agent, or Firm* — Nasser Ashgriz; UIPatent Inc.

(57) ABSTRACT

A combination of a set of musical instruments and accessories to form a musical toy figurine is disclosed. The musical toy figurine comprising a head part; a stomach part; a right-arm part; a left-arm part; a right-leg part and a left-leg part, wherein each part comprises of at least a musical instrument and accessories and is detachable to be used as a musical instrument individually or in combination with each other to create a new musical toy; and wherein each part is hollow having a plurality of apertures to make a plurality of combination of sounds to escape from each part, and wherein each part including at least an attachment means attachable to one another to create a new musical toy figurine configured to play as a new musical instrument with a new combination of sounds.

9 Claims, 10 Drawing Sheets

MELODIMAN MUSICAL TOY FIGURINE

CROSS REFERENCE TO RELATED APPLICATIONS

This application claims priority to provisional U.S. Patent Application No. 63/217,753, filed Jul. 1, 2021, the aforementioned application being hereby incorporated by reference in its entirety.

FIELD OF THE INVENTION

The present invention relates in general to musical-toy-figurines, and in specific to a musical-toy-figurine with interchangeable body parts each embodying a singular or a plurality of musical instruments or musical accessories.

BACKGROUND OF THE INVENTION

Different types of musical-toy-figurines are available, which are used to make different sounds. Toy figurines also with a detachable body portion that may be interchangeably received by another toy figurines have also been disclosed. These body parts play various musical instruments which promote creativity and imagination, letting a user make different musical instruments and compose music with their own original sounds. These toys can be used to teach users how different kinds of sounds can affect each other. By having such musical elements, users can compose their own music and invent different kinds of sound combinations.

SUMMARY OF THE INVENTION

The present invention relates to a musical toy figurine comprising a stomach-part, a head-part, a right-arm-part, a left-arm-part, a right-leg-part and a left-leg-part, wherein each part consists of at least a musical instrument or at least a musical accessory and each part is changeable and replaceable.

The body parts may all contain individual musical elements and can be disassembled and reassembled using various mounting methods, including, but not limited to, magnets, Velcro, buttons, clips, spring mounted fasteners, screw-on fasteners, and male to female fasteners. Body parts embodying musical instruments may be removed from musical-toy-figurine and reassembled, resulting to create a new musical instrument. Body parts embodying musical accessories such as batteries, cameras, microphones and etc. can be removed from musical-toy-figurine and attached to another musical instrument or device such as a smart phone.

Users can build custom musical-toy-figurines based on their choice of instruments. The body parts of musical-toy figurines can be interchanged with each other. Instruments may be removed from musical-toy-figurine, and reinstalled to the same musical-toy-figurine, or another toy figurine, by the same user resulting in new musical combination.

The musical-toy-figurine embodies musical instruments including, but not limited to, tambourines, shakers, clackers, bells, triangle chimes, drums, cymbals, musical-washboards, rattles, xylophones, whistles, kalimbas, harmonicas, melodicas, flutes, kazoos, horns, accordions, guitars, violins, pianos, ukuleles, banjos and harps.

The musical-toy-figurine embodies musical accessories including but not limited to tuners, metronomes, microphones, speakers, guitar pick holders, mallet holders, drum stick holders, bow holders, smartphone holders, instrument holders, battery, camera and light.

The shape of the musical toy figurine can be changed into different shapes, characters and forms, and can function as many different instruments as possible that work individually or simultaneously with each other.

In one embodiment the musical toy comprises a platform-base to store and hold instruments or accessories and is changeable and replaceable. Platform-base may include a built-in battery. Battery may connect to said device by various means, including male to female wire adaptor and magnetic adapter.

The musical toy can be used as ornamental and decorative device, wherein each part of the musical toy includes a hanging element to be hung onto objects including, but not limited to trees and walls, as well as other instruments and musical accessories, while further utilizing various features as lights and speakers.

The musical toy further has latching elements for wearing by the user wherein each of the body-parts of the musical toy consists of a musical instrument and is changeable, replaceable and wearable. Latching elements may include clips, couplers, pins, unique grooves, Velcro, buttons, straps, zippers and magnets. Latching elements may attach to articles of clothing, shoes, hats, as well as arms, legs and feet of the user.

The invention can be disassembled and reassembled so that instruments within the embodiment can be changed. Users can build custom musical-toy-figurines based on their choice of instruments. Body parts, such as heads, arms and legs, can be swapped building a musical-toy-figurine with a new visual look and custom sound.

Instruments can be played one at a time or in unison with each other, by one player or many players at the same time. One instrument can be shared between two or more users or used by one user at a time. One, two, or more users can mix and match instruments during a performance.

Therefore, it is an object of the present invention to provide a musical toy for users to become active instrument builders with combinations of instruments that are specific to the sound they are trying to achieve and learn how different combinations of instruments sound together.

It is another object of the present invention that can be used as a musical instrument, ornamental and decorative musical instrument, musical accessories and musical instrument holders.

It is another object of the present invention to provide a toy that the user can build a musical-toy-figurine with a custom sound and costume visual look.

It is another object of the present invention that can be used as a playable instrument and music device for adults and children and to help influence music education by attracting users to instruments.

It is another object of the present invention that can be used as a wearable instrument, allowing a musician to further explore their ability to produce sounds with their own limbs, including arms, legs and feet.

It is another object of the present invention to share its own battery power to musical accessories through a wired, chorded or magnetic adaptors.

BRIEF DESCRIPTION OF THE DRAWINGS

Embodiments herein will hereinafter be described in conjunction with the appended drawings provided to illustrate and not to limit the scope of the claims, wherein like designations denote like elements, and in which:

DETAILED DESCRIPTION OF PREFERRED EMBODIMENTS

Figure 1:
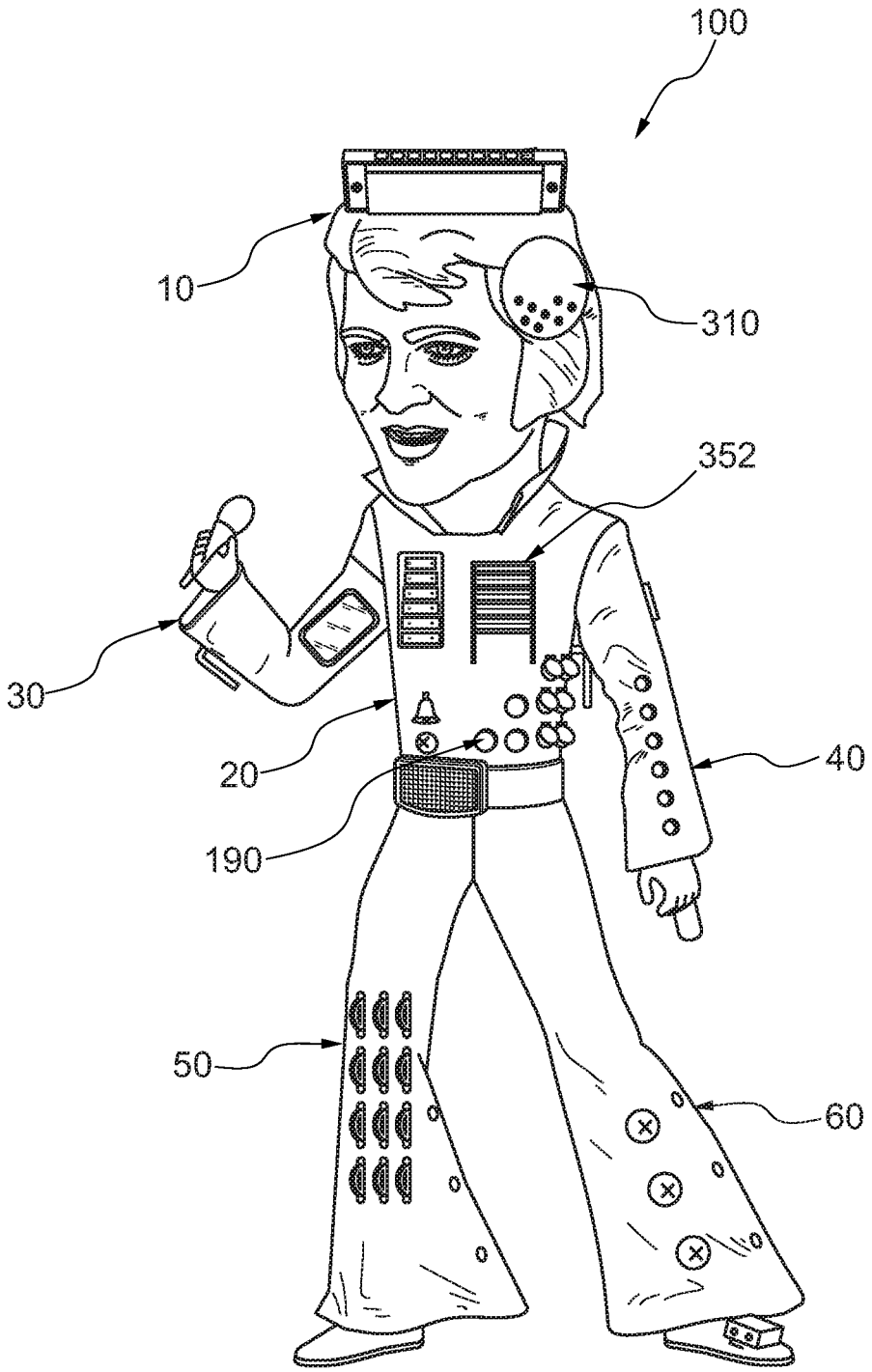
FIG. 1 illustrates an embodiment of a musical toy showing the body limbs attached together according to the present invention.

According to FIG. 1 the musical toy 100 comprising a head part 10, a stomach-part 20, a left-arm-part 30, a right-arm-part 40, a left-leg-part 50 and a right-leg-part 60, wherein each part consists of a musical instrument and is changeable and replaceable. Each part stores or holds instruments or accessories, and is changeable and replaceable.

Figure 2:
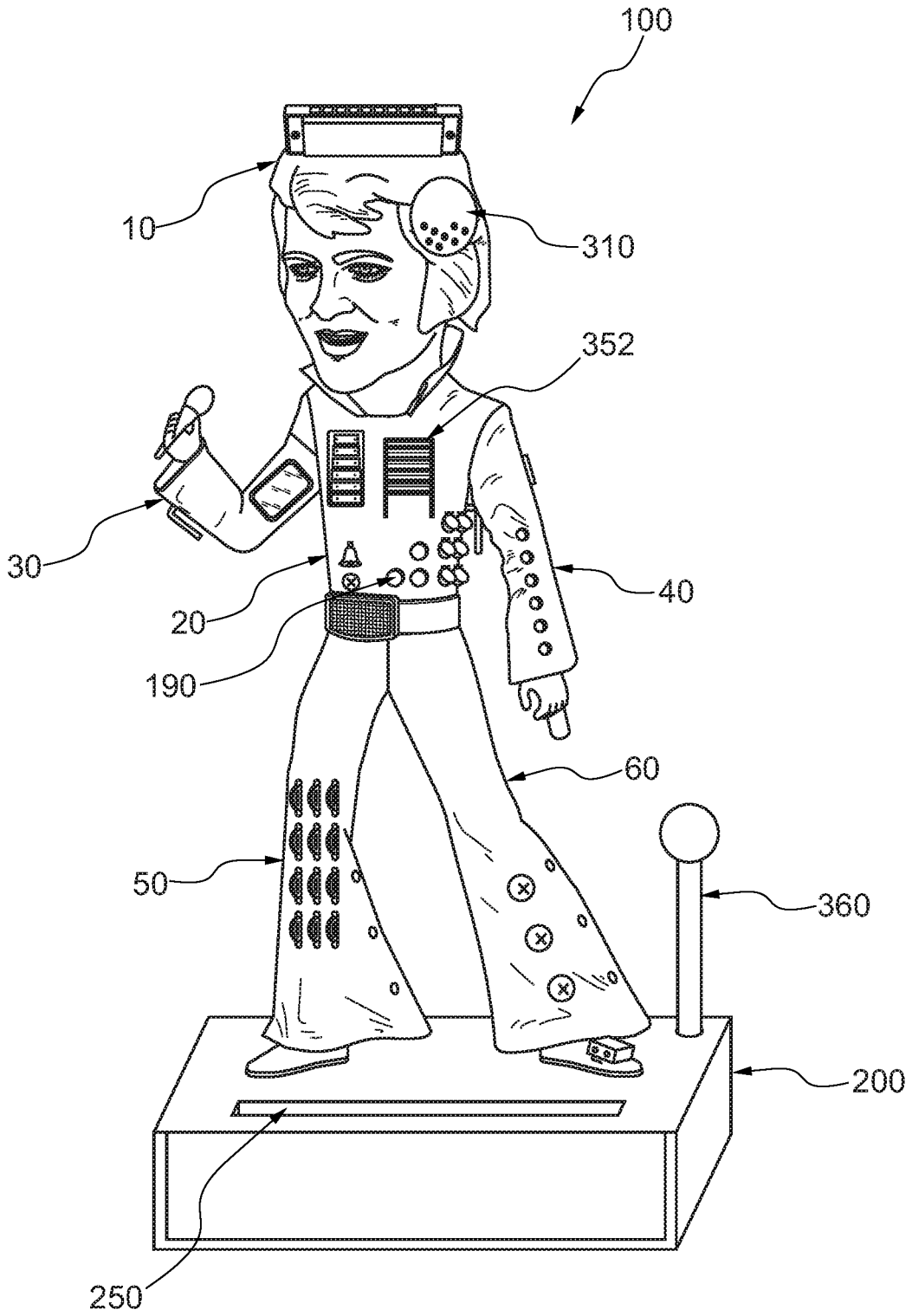
FIG. 2 illustrates the musical toy of the present invention with a platform-base according to FIG. 1.
Figure 3:
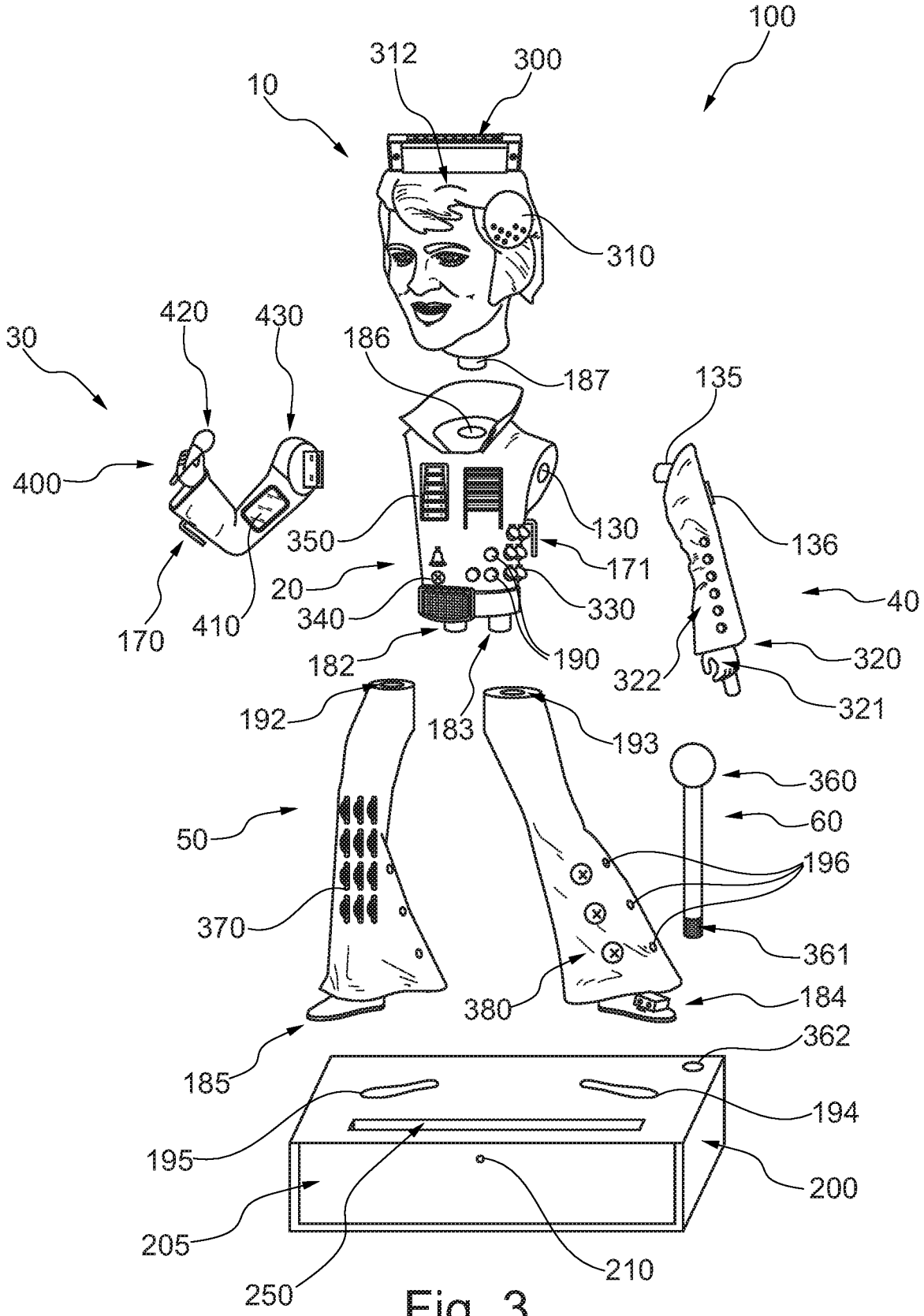
FIG. 3 illustrates the present invention disassembled showing the body parts each including individual instruments and accessories.

According to FIGS. 2 and 3 the body parts of the musical toy 100 are assembled with individual musical instruments and accessories which are connected to each other with various attachment means. Plurality female button connectors are provided on the body parts to receive the male buttons installed on the plurality of instrument elements embodying bells, tambourines, clackers, xylophones, triangle chimes, kazoos, flutes, harmonica, etc. The musical toy 100 can also have a detachable platform-base 200, which may also embody an instrument and includes attachment means for holding a smart phone. Platform-base 200 may also embody a charging port.

FIG. 3 shows the individual body parts each embodying at least a musical instrument. The musical instruments include air-instruments, percussion instruments and string instruments. Air-instruments including but not limited to air-instruments such as Melodicas, Harmonicas, Accordions, Flutes, Clarinets, Horns. Percussion instruments including, but not limited to, Tambourines, Shakers, Clackers, Bells, Musical Washboards, Mallets, Vibraslaps, Kalimbas, Xylophones, Triangle Chimes and string instruments including but not limited to Guitars and Harps.

In one embodiment the present invention embodies a harmonica 300 and a shaker 310 instrument on the head part 10. The head part 10 is hollow embodying shaker beads within its structure to create the percussive sound as they collide with each other and to the head part walls. The shaker 310 can be created in various parts of the body of the musical toy 100. Therefore, the body parts may have a door to open and fill the hallow part with beads and enclose it. The method of creating the percussion sound involves shaking and moving the toy figurine back and forth. The method of creating the air-instrument harmonica sound involves blowing air into the mouthpiece. Air will flow over musical reeds inside harmonica, vibrating the reeds and creating a musical sound. Longer reeds make lower pitched sounds while shorter reeds make higher pitches sounds when they vibrate.

The stomach-part 20 embodies Xylophone musical instrument 350, clacker musical instrument 330, bells musical instrument 340 and washboard 352. Xylophone instrument 350 comprises of a plurality of bars with different sizes that make higher pitched sounds to lower pitched sounds. Percussion instruments such as xylophones require the user to hit the instrument with a stick or mallet. Stick or mallet 360 can be mounted on the platform-base 200. Xylophone bars may also be permanently installed on various parts of the stomach-part 20. The washboard instrument 352 is played by moving a stick, brush, or fingers over the edges of the board. The musical instruments can be connected to the stomach-part 20 by various attachment means depending on the material of the musical toy 100 including but not limited to magnet, Velcro, clips, buttons, etc.

The stomach-part 20 further comprises Clackers musical instrument 330. Clackers 330 are made from a series of plates that are bound together on one end and open on the other end. When shaken or moved, the open side of the plates hit each other, creating a sound. Larger plates make lower pitched sounds while smaller plates make higher pitched sounds. Clackers 330 can be mounted onto or inside the body of the musical toy 100.

The stomach-part 20 further comprises Bells musical instrument 340. Bells 340 consist of a small ball contained within a metal sphere. When shaken, the ball hit the sphere, vibrating it and creating a musical sound. Larger metal spheres create a lower pitched sound while smaller metal spheres create a higher pitched sound. Bells can be mounted onto or inside the body parts of the toy figurine 100.

There are different attachment methods designed on the body parts of the musical toy 100. Referring to FIG. 3 again plurality of attachments 190 are mounted on the stomach-part of the toy to receive bells musical elements 340 or other instruments. Such these attachment means are provided on various parts of the body parts of the musical toy. Other attachment methods including but not limited to magnetic attachments, clips, buttons or Velcro can be used. The stomach-part 20 resembles a musical instrument combining of a bell 340, Xylophone 350, clacker 330 and washboard 352.

The left-arm 30 of the musical toy 100 embodies musical accessories including but not limited to Tuners, Metronomes, Cameras, Microphones and Speakers. In one embodiment the left arm embodies a musical instrument tuner 400, an interactive digital display screen 410, a microphone 420 and a USB connector 430. The left arm can be attached to various musical instruments.

The right-arm 40 embodies a flute musical element 320. Air instruments such as flute may embody valves or slide-rods to allow for users and musicians to change notes while playing. To make air-instrument musical sounds, the player must blow air into the mouthpiece 321. As described before, the musical toy comprises of hollow body parts. A plurality of air holes 322 on the right-arm or flute 320 allows for activation the musical instrument. Sounds change when the user blow air into the flute mouthpiece 321 and covers or uncovers holes. Sounds also change when the user blows air into the mouthpiece 321 and moves the slide-rod making the air chamber smaller and larger thus affecting the sound to high and low tone.

The left leg 50 embodies tambourine musical element 370. Tambourines are made up of jingles that are loosely mounted to a pin. When shaken, the jingles hit each other, creating a sound. Larger jingles produce lower tone notes while smaller jingles make a higher tone notes. Different metals or materials that make up the jingles will influence the sounds they produce. The right leg 60 embodies bells musical elements 380.

The body limbs of the musical toy are hollow with a plurality hole 196 to allow sound from the body enclosure to escape. These holes are installed in the stomach-parts including the head-part, stomach-part, right-arm, left-arm, right-leg and left-leg of the musical toy. These holes 196 may also be found on the instrument platform-base 200.

Figure 9:
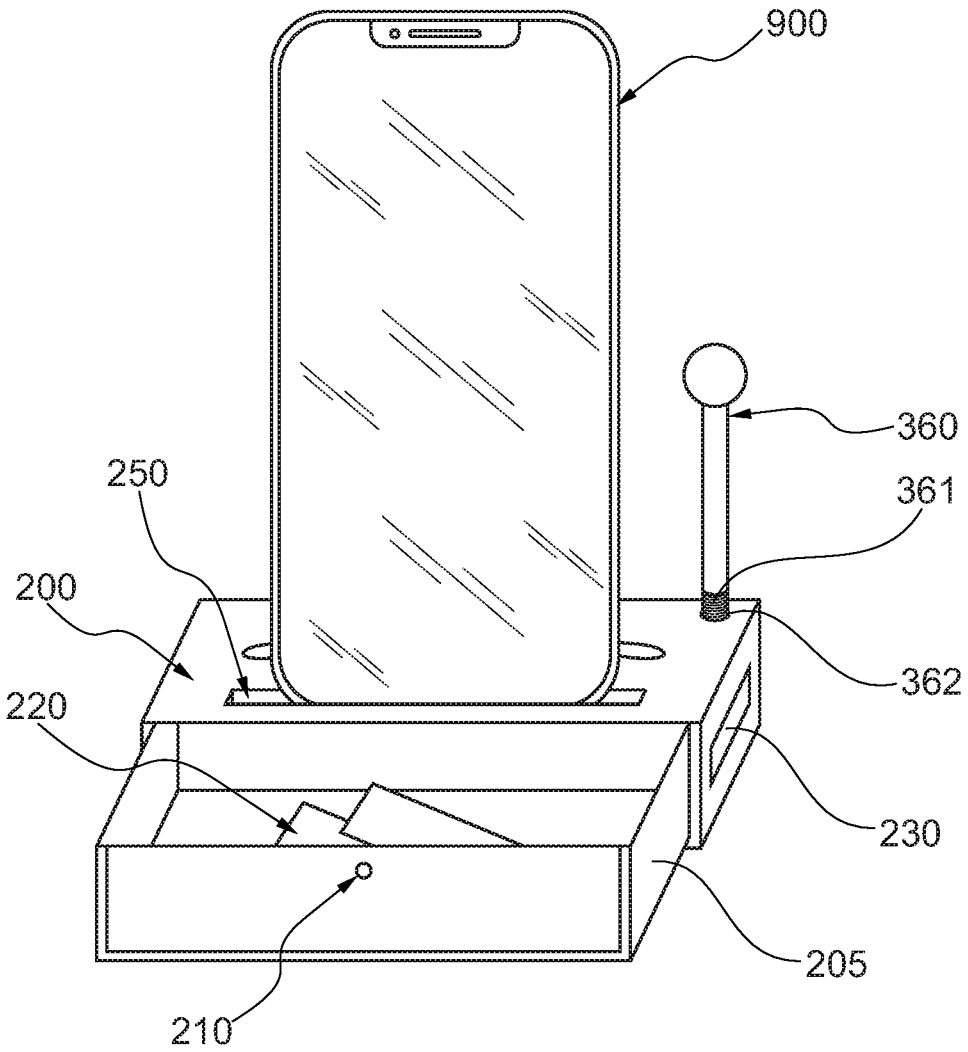
FIG. 9 illustrates the musical toy with platform-base comprising a compartment for holding a xylophone musical instrument, a mallet holder and used as a mobile phone holder.

According to FIG. 3 again and FIG. 9, the toy figurine comprises a platform-base 200 to hold and store musical instruments and accessories. The platform-base 200 comprises a drawer compartment 205 to store loose instruments and musical accessories such as loose xylophone keys 220. Platform-base can be used as a Xylophone musical instrument attached to the side wall 230 of the platform-base 200. The platform 200 can take the shape of characters, such as an animal, a car, etc.

Instruments such as Xylophones and Drums make sounds when the user hits the instrument with a Mallet or Drum Stick 360. Therefore, the platform base 200 has a groove 362 adapted to receive a mallet or a drum stick 360, wherein the male threaded attachment 361 of the mallet fastens inside the groove of the base 362. A handle 210 is provided to open and close the compartment 205. The platform-base 200 further has a grooved holder 250 adapted to receive a mobile phone 900 or other musical instruments. Platform-base 200 may also embody magnets or grooves to attach a musical accessory or a mallet or other instruments, such as a guitar or banjo and can be used to store additional instruments when not in use.

Figure 4A:
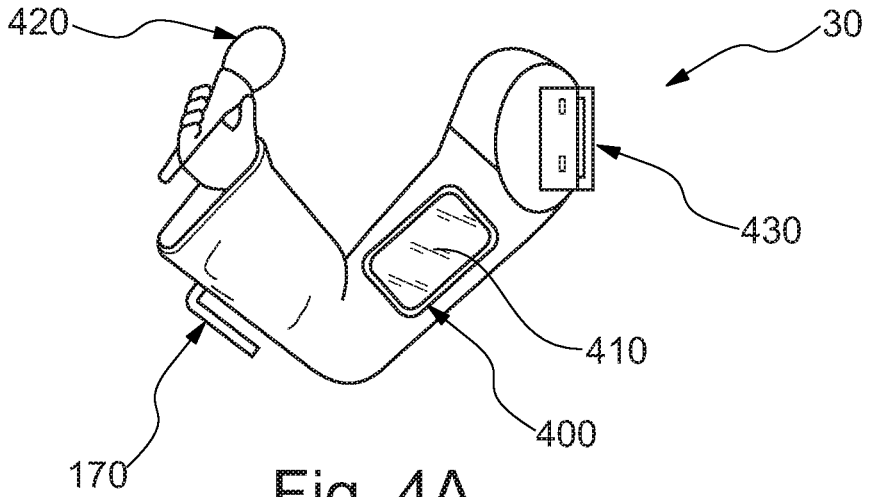
FIG. 4A illustrates the left-arm of the musical toy, embodying an instrument tuner, a digital display and a USB connector.
Figure 4B:
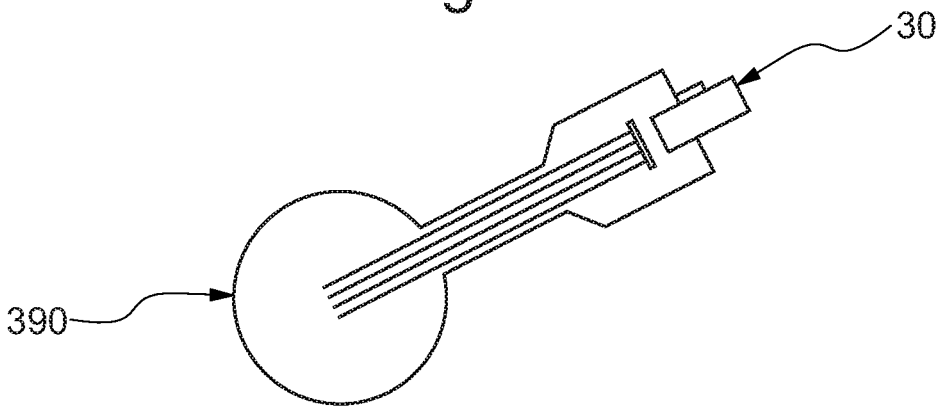
FIG. 4B illustrates the left-arm of the musical toy attached to a banjo and used as an instrument tuner.
Figure 4C:
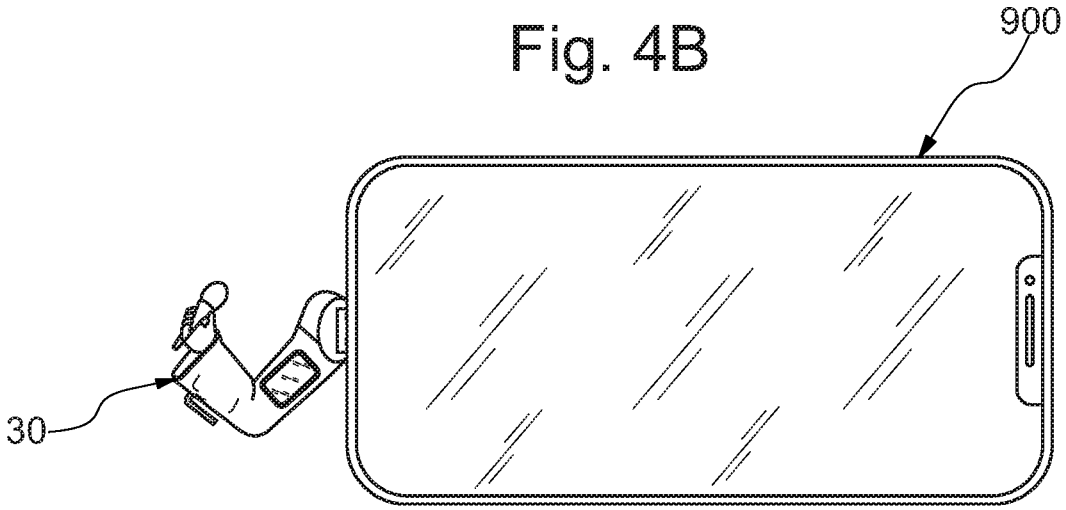
FIG. 4C illustrates the left-arm of the musical toy attached to a smart phone used as a charger.

According to FIGS. 4A to 4C the left-arm 30 of the musical toy embodies a musical instrument tuner 400 attachable to other musical instruments by a spring mounted clip 170. The left-arm further comprises a digital display screen 410, a microphone 420 and a USB connector 430 and a magnetic-connector (not shown). FIG. 4B illustrates the left-arm 30 attached to a banjo 390 and used as an instrument tuner. The left-arm 30 can be attached to a musical accessory, smart device or smart phone using magnets and can be used as a charger. FIG. 4C illustrates the left-arm 30 attached to a smart phone 900 as a charger.

Figure 5A:
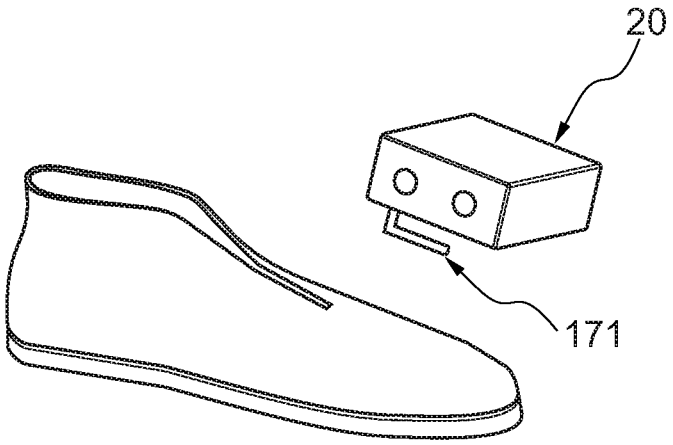
FIG. 5A illustrates the body-part of the musical toy having a clip attachment.
Figure 5B:
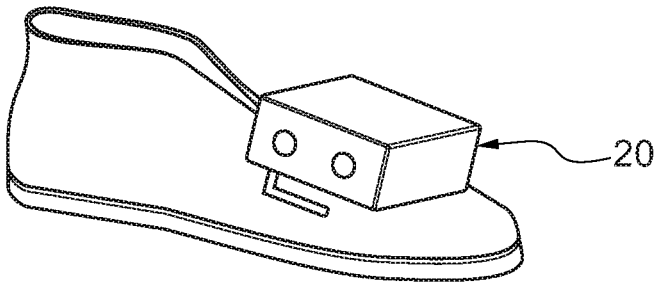
FIG. 5B illustrates the body-part of the musical toy clipped to shoe laces, making a foot-activated musical instrument.

FIGS. 5A and 5B show the stomach-part 20 attached to shoe laces by a clip 171 making a foot-activated musical instrument. Various body parts of the musical toy comprising the head-part 10, stomach-part 20, left-arm-part 30, right arm part 40, right-leg-part 50 and a left-leg-part 60 each consists of a musical instrument and can be attached to the articles of the clothing and shoes by latching elements and are changeable and replaceable. Latching elements may include but not limited to clips, couplers, pins, unique grooves, Velcro, buttons, pins, magnets, belts, straps and zippers. Latching element may attach to bare arms, legs and feet. A corresponding clip may attach to user using clips, couplers, pins, unique grooves, Velcro, buttons, pins, magnets, straps and zippers. These corresponding clips may be stored in the base platform 200.

There are different connection methods designed on the body limbs of the musical toy 100 to attach various parts together. According to FIG. 3 again the head part 10 has an attachment mechanism to connect to the stomach-part 20. In one embodiment this attachment is enhanced by male coupler attachment 187 on the head part 10 to the female coupler attachment 186 on the stomach-part. In another embodiment the connection can be enhanced by magnetic connectors.

The attachment of the left arm to the stomach-part is through various attachment methods being tongue and groove attachment, or male to female groove attachment. The connection of the right arm to the body is by male thread attachment 135 on the right arm to the female thread attachment 130 on the stomach-part 20. The attachment of the left-leg 50 and right-leg 60 is by male coupler attachments 182-183 on the stomach-part 20 and female coupler attachments 192-193 on the leg parts. The leg parts 50 and 60 are further attached to the platform-base 200 by magnetic attachments 184 and 185. Magnetic attachments 194-195 on the platform base receive the musical toy or other instruments.

Figure 6A:
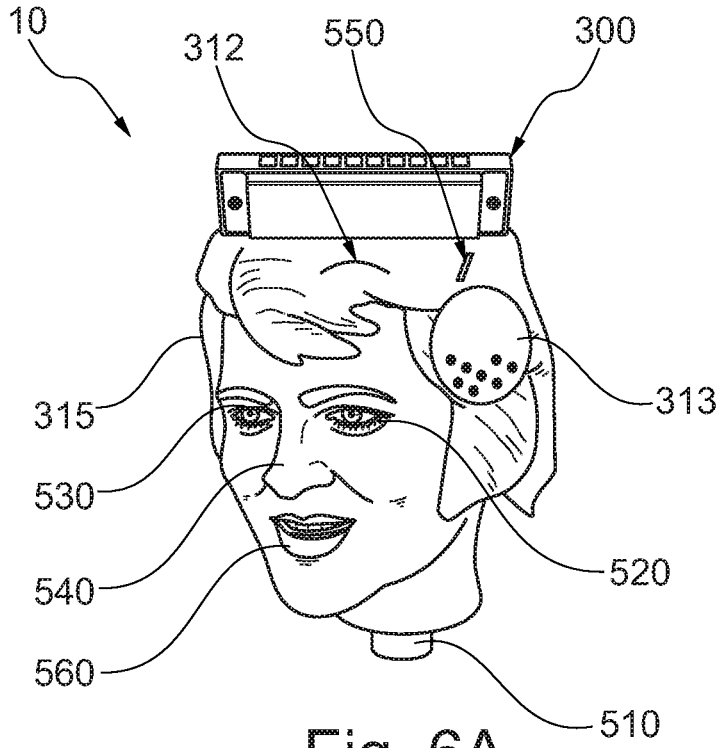
FIG. 6A illustrates a detailed view of the head-part of the musical toy.
Figure 6B:
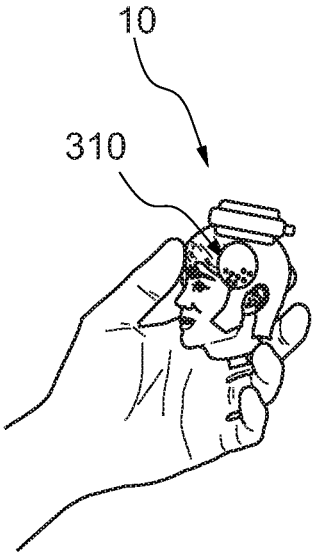
FIG. 6B illustrates the head-part used as a shaker musical instrument.
Figure 6C:
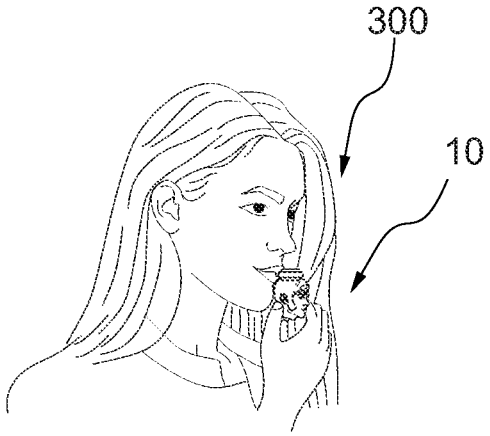
FIG. 6C illustrates the head-part used as a harmonica musical instrument.

FIGS. 6A, 6B and 6C show the head part 10 used individually as musical instrument. The head part 10 is being held by a human hand and used individually as a shaker musical element 310 (FIG. 6B) or a harmonica musical element 300 (FIG. 6C).

According to FIG. 6A again the head part 10 may have musical accessories including but not limited to a microphone 530, a memory card slot 550, lights 520, speakers 560, USB connectors 510 and camera 540. The accessories can be installed on various face parts of the head 10 such as on eyes, nose and lips. Musical sounds of the present invention can be amplified through speakers 560. The Microphone 530 assists in audio recording and lights 520 including LED lights, or flashing lights may act as decorative ornaments.

The head part 10 further can be used as an ornamental element for hanging on the wall or tree by a hook element 312 or attach to the clothing by Velcro hooks and loops 313 and 315 attachments.

Figure 7A:
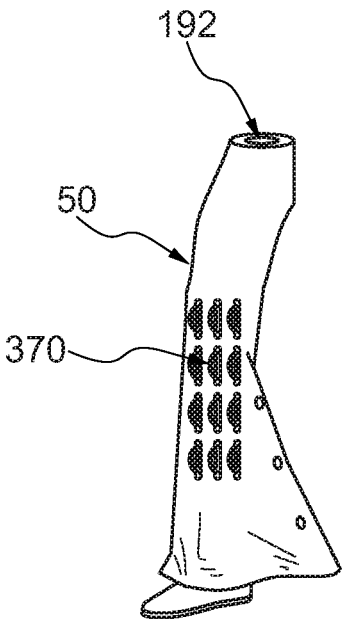
FIG. 7A illustrates the left-leg-part of the musical toy embodying a tambourine musical instrument.
Figure 7B:
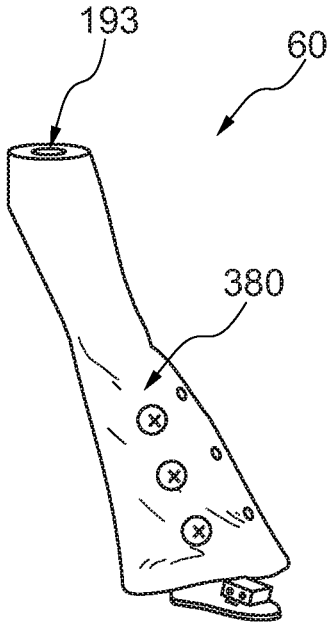
FIG. 7B illustrates the right-leg-part of the musical toy embodying a bell musical instrument.
Figure 7C:
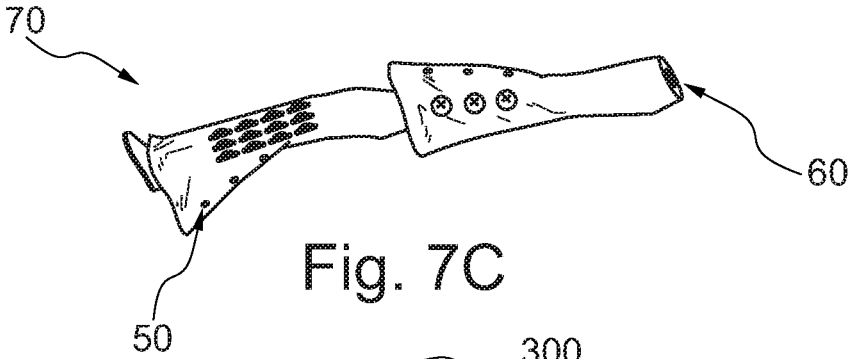
FIG. 7C illustrates the left-leg-part and the right-leg-part attached together combining two musical instruments.
Figure 7D:
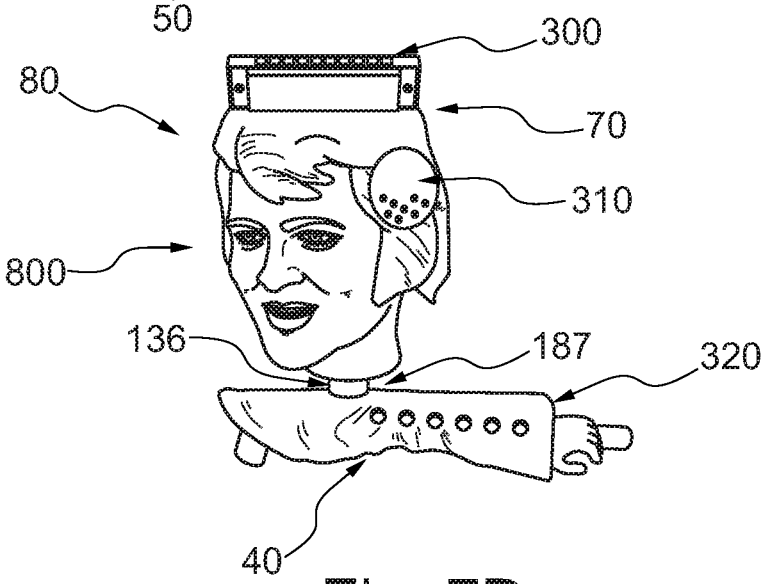
FIG. 7D illustrates the head-part and the right-arm-part attached together combining various musical instruments.

Various body parts can be removed from musical toy, and reinstalled to each other to build a new musical instrument. According to FIG. 7A to 7D the left-leg part 50 which embodies a tambourine musical instrument 370 is combined with the right-leg 60 that embodies bells musical instrument 380. The new musical instrument 70 is a combination of a tambourine and bells. The left-leg 50 and right-leg 60 are attached by male and female coupler attachments 192 and 193 or other suitable attachment means. The new music instrument 70 is a combination of two percussion instruments a bell instrument 380 and a tambourine 370 which vibrate upon being struck. FIG. 7D shows the head part 10 which embodies harmonica music instrument 300 and shakers musical instrument 310 attached to the right-arm 40 embodying flute musical instrument 320. The combination creates a new musical instrument 80 combining two sets of instruments, and three unique sounds in total (Harmonica, Shaker, and Flute). The attachment is enhanced by male and female coupler attachments 136 and 187 mounted on the head part 10 and the right-arm 40 of the musical toy.

Each part of the musical-toy is at least a musical instrument or a musical accessory. Body parts can be removed from musical-toy and be used as a musical instrument or accessory. Musical accessories include, but are not limited to lights, microphones, instrument tuners, metronomes, audio recorders, video recorders, MIDI recorders and output speakers with batteries, memory card slots, microprocessors, CPUs and USB connectors for digital file transferring, MIDI instrument connection, and charging. Instrument tuners are used to let users tune their instrument. Metronomes are used to help the musician keep time by producing a timed clicking sound set by the user. Metronomes may also notify users by producing a timed flashing light set by the user. Audio and Video recorders allow the user to record song demos and live performances. Output speakers allow the user to hear back their recordings and audio from a paired electronic smart device. Headphone outputs and microphone inputs may also be found within the accessories arm of the present invention.

Figure 8:
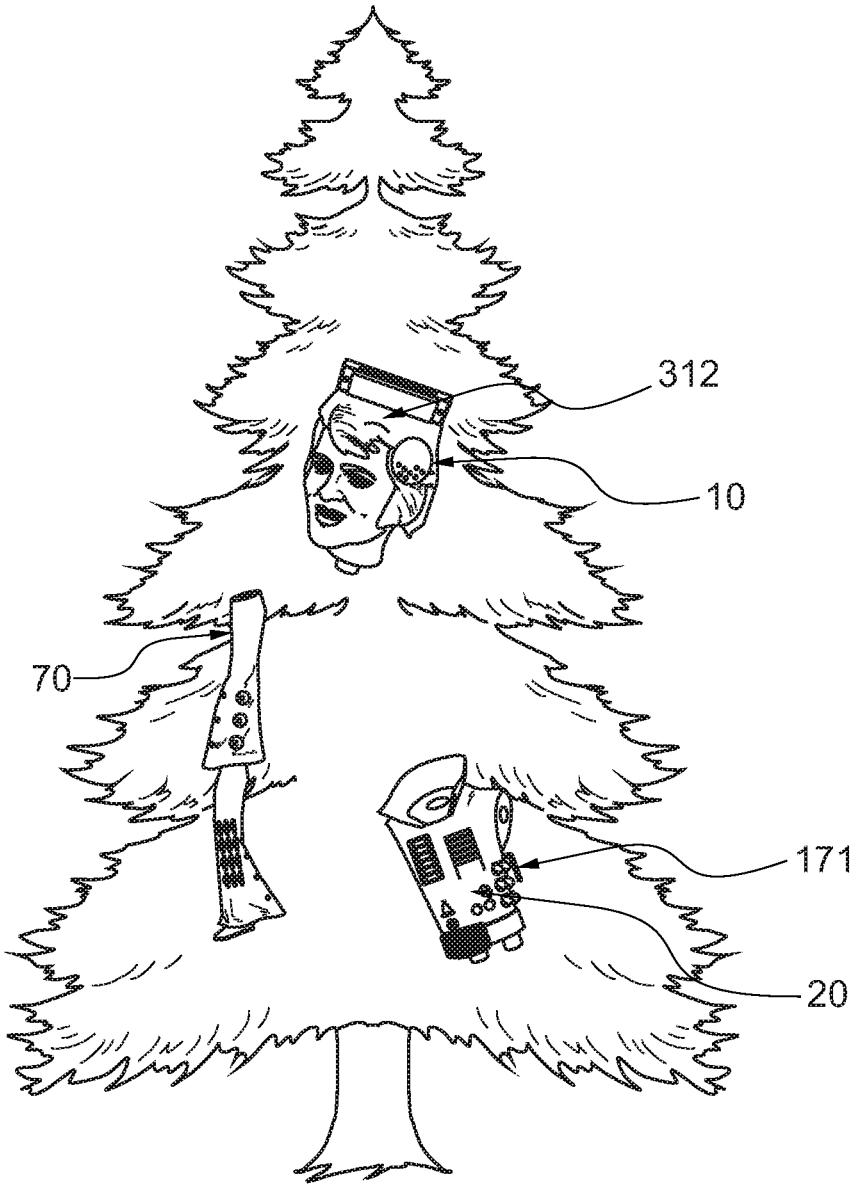
FIG. 8 illustrates the musical toy parts disassembled and used as ornaments on a tree.

As shown in FIG. 8 the body parts of the musical toy can be used as an ornamental and decorative element. Each part may have a hanging element to be hung to objects. The head part 10 comprises a hanging element 312 to be hung onto objects including, but not limited to trees, ceilings and walls. The body part of the musical toy further has a hook attachment 171 to be hung onto a tree or to be attached to the apparel such as shoes. The left-arm further has a spring mounted attachment clip 170 (as shown in FIG. 3) to be attached to other instruments such as violin, banjo and guitar. Instrument can be hung onto objects while utilizing musical features.

Figure 10A:
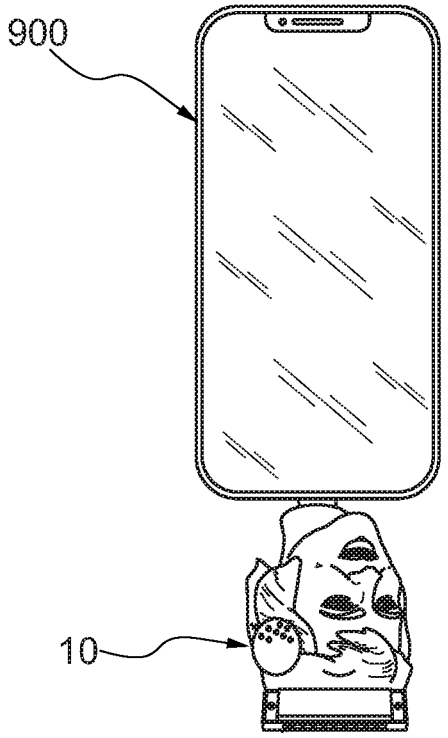
FIG. 10A illustrates the head part as a charger attaching to the USB input.
Figure 10B:
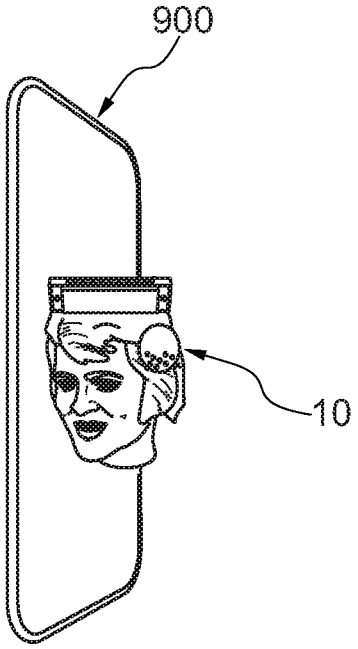
FIG. 10B illustrates the head part as a charging device magnetically attached to the back of the device.
Figure 10C:
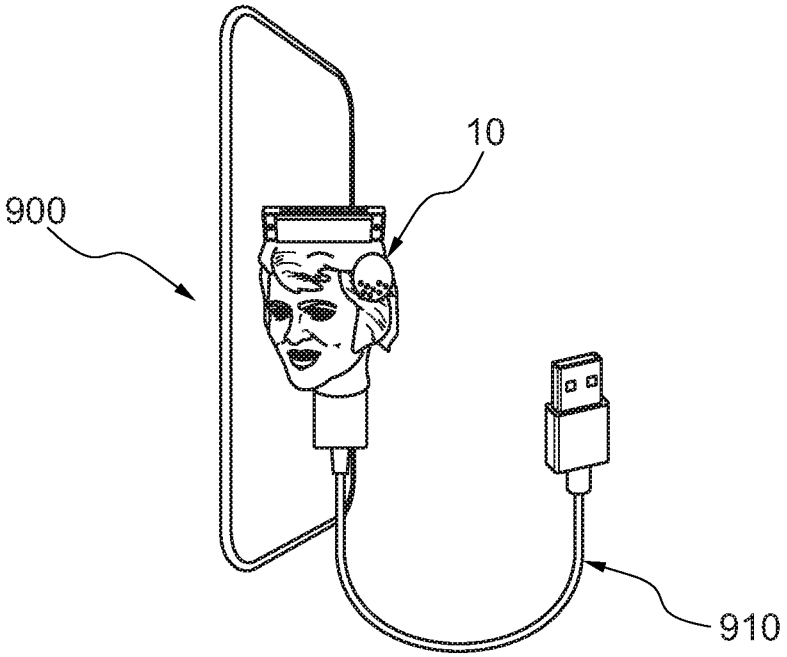
FIG. 10C illustrates the head part as a charging device connected to a power source using a wired adaptor.

As illustrated in FIGS. 10A to 10C head part 10 may also be used as a charging device, utilizing its own internal battery to transfer DC power to another device, or by plugging head part into an AC power source and attaching it to the musical accessory device. Head-part 10 will convert AC power into DC power to charge musical accessories.

As illustrated in FIG. 10C, the body part 10 can further be used as an accessory charger such as a smart phone or a musical accessory by using the USB input or as shown in FIG. 10B magnetically to the back of a device. The body part may use its own internal battery to power the accessory. The body part 10 may also connect to a power source using a wired adaptor, such as a USB chord 910.

The present invention relates to musical toys including, but are not limited to plush toys, toy action figurines, stuffed toy figurines, toy animals figurines, statues, mannequins, toy automobiles, toy boats, toy plants, toy faces, toy bodies, animal and human shaped figurines containing playable musical elements. Body parts can be removed from musical toy and switched with another musical toy, resulting a new musical toy with new figure and new musical combinations. Body parts can also be used as musical accessories that would assist or entertain the user. Each body part of the musical toy 100 performs a musical task, either acoustic or electronic, and each is interchangeable with each other.

The present invention may comprise electronic devices to assist in audio recording, including but not limited to Instrument Tuners, Microphones, Megaphones, Turntables, Bluetooth audio transmitter, Cameras, Wifi receiver, Volume Knobs, Buttons, Auxiliary Audio Input/Output Charging. The electronic devices may operate on current electricity or may charge internal batteries using various sources, including solar cells.

The present invention provides WIFI and Bluetooth technology to allow for users to pair external devices such as smart phones with the output speakers of the present invention. Lights blink to keep or to show the present tempo, and can also act as decorative elements to the musical toy. Lights can also be controlled and manipulated using WIFI and Bluetooth technology when paired with a smart phone or external device. Platform-base 200 may also embody a charging port. Music accessories of the present invention also include pick holders and instruments holders.

Instruments can be played one at a time or in unison with each other, by one player or many players at the same time. One instrument can be shared between two or more users or used by one user at a time. One, two, or more users can mix and match instruments during a performance.

In one embodiment Items worn by the musical-toy, including glasses, belts, sunglasses, boots, hats and gloves, can also contain musical instruments or accessories.

The musical-toy of the present invention can be made out of various materials including, but not limited to, plastic, wood, cotton, silicone, polyester, metal, copper, and brass. The material used may also glow in the dark or illuminate under special lighting, such as black light or neon light.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

What is claimed is:

1. A combination of a set of musical instruments and accessories to form a musical toy figurine comprising a head part; a stomach part; a right-arm part; a left-arm part; a right-leg part and a left-leg part, wherein each part comprises of at least a musical instrument and accessories and is detachable to be used as a musical instrument individually or in combination with each other to create a new musical toy; and wherein each part having a hollow with a plurality of apertures to make a plurality of combination of sounds to be escape from each part, and wherein each part including at least an attachment means attachable to one another to create a new musical toy figurine configured to play as a new musical instrument with a new combination of sounds.

2. The musical-toy-figurine of claim 1, wherein said attachment means are selected from the group consisting any one of hook and loop attachment, buttons, magnets, clips, belts, spring mounted fasteners, straps, screw-on fasteners, pins, zippers or male to female couplers.

3. The musical-toy-figurine of claim 1, wherein the set of musical instruments comprising:

percussion instruments selected from the group consisting anyone of tambourines, shakers, clackers, kalimbas, bells, musical washboard, rattles, xylophones, glockenspiel, triangle chimes, cymbals, drums, vibraslap and cowbell;

air-instruments selected from the group consisting anyone of harmonicas, flutes, kazoos, horns, melodicas, accordions, clarinet, whistles, and string instruments, string instruments selected from the group consisting anyone of harps, ukuleles, banjos, guitars, violins, autoharp and piano instruments, whereby the percussion instruments make idiophone or percussion sounds when hit with a mallet or drum stick or being shaked and the air-instruments make aerophone sounds by blowing or pumping air into them and the string instruments make sounds when plucked with fingers or an instrument pick, or hit with a mallet, stick, or a piano key.

4. The musical-toy-figurine of claim 1, wherein the set of accessories selected from the group consisting anyone of tuners, metronome, microphones, speakers, guitar pick holders, smartphone holders, instrument holders, camera and light, audio recorders, video recorders, battery-chargers, batteries, memory card slots, microprocessors and CPUs, wireless audio connectivity, wireless accessory connectivity, wireless internet connectivity, whereby said accessories assist in audio recording, amplifying the sounds of the musical instruments and or flashing lights for musical-timing and for decorative ornaments.

5. The musical-toy-figurine of claim 1, further having a platform configured to hold said musical-toy-figurine, said musical instruments and said accessories, said platform comprising:

a drawer compartment to receive a plurality of loose musical instruments;

a groove to receive a mallet or a drum stick for percussion instruments;

a plurality of grooved holders configured to receive musical instruments and musical accessories;

a mobile phone holder, and a charging port, whereby the musical-toy-figurine pairs with accessories through WIFI and Bluetooth or by magnetic and wired adapters.

6. The musical-toy-figurine of claim 1, wherein the musical-toy-figurine is attached to the platform by a magnet.

7. The musical-toy-figurine of claim 1, wherein the musical-toy-figurine selected from the group consisting anyone of plush toys, toy action figurines, stuffed toy figurines, toy animals figurines, statues, mannequins, toy automobiles, toy boats, toy plants, toy faces, toy bodies and human shaped figurines containing playable musical elements.

8. The musical-toy-figurine of claim 1, wherein the musical-toy-figurine selected from the group consisting anyone of a completely non-electronic acoustic instruments, electric tuner/recorder or a combination of both to make a plurality of combination of sounds.

9. A combination of a set of musical instruments and accessories to form a musical toy figurine comprising a head part; a stomach part; a right-arm part; a left-arm part; a right-leg part and a left-leg part, wherein each part comprises of at least a musical instrument and accessories to be used as a musical instrument individually or in combination with each other and wherein each part having a hollow with a plurality of apertures to make a plurality of combination of sounds to be escape from each part, and wherein each part comprising at least an attachment means attachable to one another to create a new musical toy figurine configured to play as a new musical instrument with a new combination of sounds.

* * * * *